US007868833B2

(12) United States Patent
Tonn

(10) Patent No.: US 7,868,833 B2
(45) Date of Patent: Jan. 11, 2011

(54) ULTRA WIDEBAND BUOYANT CABLE ANTENNA ELEMENT

(75) Inventor: David A. Tonn, Charlestown, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 384 days.

(21) Appl. No.: 12/229,668

(22) Filed: Aug. 20, 2008

(65) Prior Publication Data

US 2010/0045545 A1 Feb. 25, 2010

(51) Int. Cl.
*H01Q 1/34* (2006.01)

(52) U.S. Cl. ..... 343/709; 343/841; 343/872; 343/900; 343/911 R; 343/749

(58) Field of Classification Search ..... 343/702, 343/700 MS, 850, 904, 907, 709
See application file for complete search history.

(56) References Cited

U.S. PATENT DOCUMENTS 3,599,213 A * 8/1971 Fessenden et al. ..... 343/710
4,463,358 A * 7/1984 Phillips ..... 343/709
4,760,348 A * 7/1988 Pease et al. ..... 330/151
6,426,464 B1 * 7/2002 Spellman et al. ..... 174/101.5
2007/0013483 A1 * 1/2007 Stewart ..... 340/10.3

* cited by examiner

*Primary Examiner*—Jacob Y Choi
*Assistant Examiner*—Darleen J Stockley
(74) *Attorney, Agent, or Firm*—James M. Kasischke; Jean-Paul A. Nasser; Michael P. Stanley

(57) ABSTRACT

The invention as disclosed is of a buoyant cable antenna for use with underwater vehicles having improved bandwidth through the use of discrete distributed loading along the antenna. The buoyant cable antenna is designed with an antenna wire that is divided into N equal length segments of length d/2. A capacitor is coupled between every other segment such that capacitors are separated by a distance d. A shunt inductor is coupled to the antenna wire between the adjoining segments not separated by a capacitor such that the shunt inductors are separated by a distance d. This antenna design provides a substantially improved impedance bandwidth over existing prior art antennas at high frequency without increasing the physical profile of the antenna and without the use of active circuit elements.

4 Claims, 3 Drawing Sheets

ULTRA WIDEBAND BUOYANT CABLE ANTENNA ELEMENT

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Field of the Invention

The present invention is directed to buoyant cable antenna elements for use with underwater vehicles. In particular, the present invention is directed to a buoyant cable antenna specifically designed to provide broadband reception in the high frequency range.

(2) Description of the Prior Art

The buoyant cable antenna is one of a host of underwater vehicle antennas currently in use for radio communications while an underwater vehicle is submerged. A buoyant cable antenna consists of a straight insulated wire that is positively buoyant and designed to float to the ocean surface. The wire may be either a solid or stranded copper conductor of uniform diameter along its length. It is connected to the underwater vehicle by means of a standard coaxial transmission line at one end, and is terminated at the other end by means of either a shorting cap to connect it to the ocean or an insulating cap to isolate it from the ocean. The choice of cap is determined by the mode of operation that is needed. Prior art buoyant cable antennas suffer from limited performance in certain frequency bands due to the resonant behavior of the antenna element. Currently, there is a need for a means to improve the bandwidth of buoyant cable antennas through the use of discrete distributed loading along the antenna.

SUMMARY OF THE INVENTION

It is a general purpose and object of the present invention to improve the bandwidth of a buoyant cable antenna by the use of discrete distributed loading along the antenna.

The above object is accomplished with the present invention through the use of an antenna wire that is divided into N equal length segments of length d/2. A capacitor is coupled between every other segment such that capacitors are separated by a distance d. A shunt inductor is coupled to the antenna wire between the adjoining segments not separated by a capacitor such that the shunt inductors are separated by a distance d. This antenna design provides a substantially improved impedance bandwidth over prior art antennas at high frequency without increasing the physical profile of the antenna and without the use of active circuit elements.

BRIEF DESCRIPTION OF THE DRAWINGS

A more complete understanding of the invention and many of the attendant advantages thereto will be more readily appreciated by referring to the following detailed description when considered in conjunction with the accompanying drawings, wherein like reference numerals refer to like parts and wherein.

DETAILED DESCRIPTION OF THE INVENTION

The standard buoyant cable antenna is modeled as a transmission line. It has a complex characteristic impedance Z0 and a complex propagation constant, γ. Its input impedance can be computed as:

$$Z_{sc}=Z_0 \tan h(\gamma l) \tag{1}$$

$$Z_{oc}=Z_0 \cot h(\gamma l) \tag{2}$$

where the "sc" and the "oc" designations refer to the use of either a short circuited or open circuited termination. Once the input impedance is known, the input voltage standing wave ratio is easily computed. This is the key figure of merit in defining the bandwidth of the antenna. Typically in communication systems, the bandwidth is defined to be that portion of the band over which the voltage standing wave ratio is less than 2:1.

Figure 1:
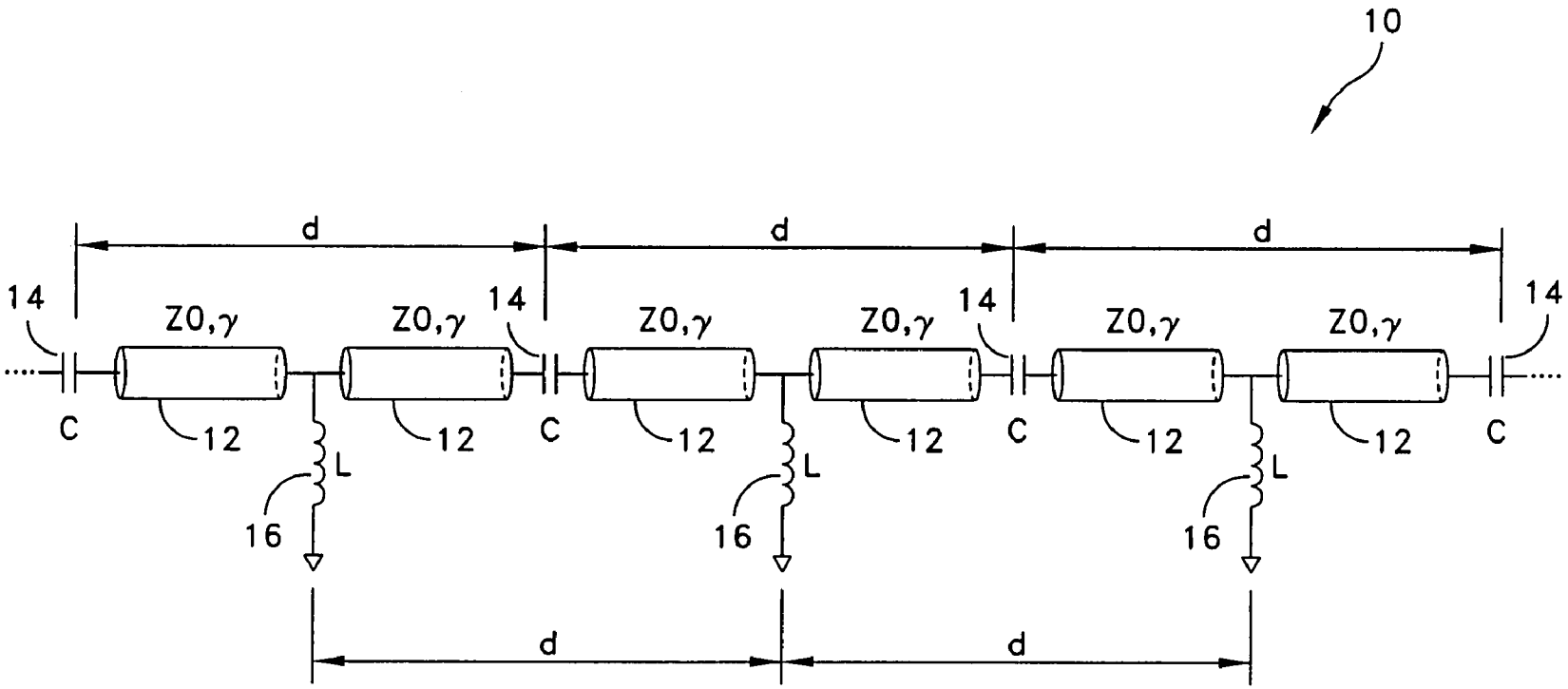
FIG. 1 illustrates the present invention in terms of the electronic components of the antenna, their spacing and the characteristics of the components including impedance, complex propagation constant, capacitance and inductance.

Referring to FIG. 1, there is illustrated the present invention using the basic antenna geometry as a point of departure. The present invention works, however, by dividing the antenna element 10 into N short segments 12 of length d/2 and by interconnecting them in series by means of capacitors 14 of value C between every other segment, thus making the spacing between the capacitors d. At the point of junction between segments that are not capacitively joined, a shunt inductor 16 of inductance value of L is placed between the conducting wire and ground. The spacing between these shunt inductors 16, then, is also d. This is illustrated in FIG. 1. The number of segments, N, is dictated by the frequency band of operation. It is desired to have the segment lengths, d/2, much shorter by at least a factor of 10 than the shortest guided wavelength of operation.

Figure 2:
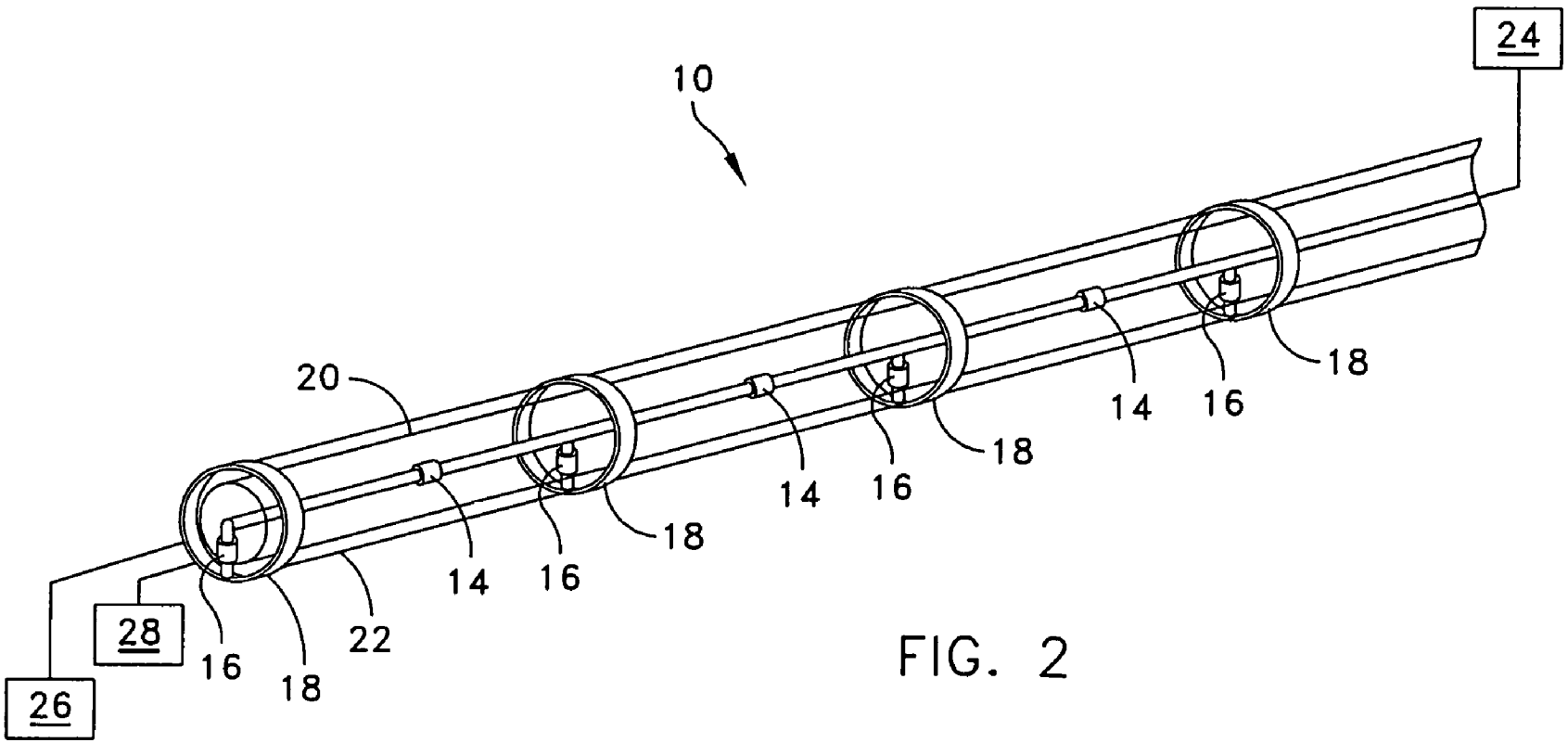
FIG. 2 illustrates the invention in terms of the physical components of the antenna.

The overall antenna structure is illustrated in FIG. 2. The antenna element 10 is insulated by two layers; a primary insulation layer 20 of buoyant dielectric material and a jacket 22 of a non-conducting water proof material. The purpose of the jacket 22 is to provide mechanical protection and durability to the antenna element 10. In this particular implementation, the shunt inductive loads 16 are grounded to the ocean by means of "grounding rings" 18 on the outer surface of the jacket 22 of the antenna that are in electrical contact with the ocean. The leads on the inductive loads penetrate the insulation layer 20 and the jacket 22 in order to make contact with the grounding ring 18. The antenna element 10 is connected to a coaxial feed line 24 on one end and is terminated at the other end by means of either a shorting cap 26 to connect it to the ocean or an insulating cap 28 to isolate it from the ocean. The choice of cap is determined by the mode of operation that is needed.

The performance of this antenna is analyzed by means of Floquet's Theorem for periodic structures. The structure illustrated in FIG. 1 can be shown to behave like a transmission line whose complex propagation constant and complex characteristic impedance satisfy the following equations:

$$\cosh\bar{\gamma}d = -\frac{Z_0 + (Z_0 - 4\omega^2 LCZ_0)\cosh\gamma d + j2\omega(L + CZ_0^2)\sinh\gamma d}{4\omega^2 LCZ_0} \quad (2)$$

$$\overline{Z_0^2} = \frac{(2\omega CZ_0\tanh(\gamma d/2) - j)[(4\omega^2 LC - 1)Z_0\cosh(\gamma d/2) - j2\omega(L + CZ_0^2)\sinh(\gamma d/2)]}{4\omega^2 C^2[2\omega L\sinh(\gamma d/2) - jZ_0\cosh(\gamma d/2)]} \quad (3)$$

where ω is the angular frequency of operation (2πf) and d, Z0, γ, L, and C are as given in FIG. 1. Note that in the square root that must be taken in equation (3), it is the branch of the root that makes the real portion of the impedance positive. A branch choice must also be made for the hyperbolic inverse cosine in equation (2) resulting in, a single-valued function. The input impedance is then calculated using the expression in equation (1), except with the Floquet propagation constant and impedance defined by equation (2) and (3) used in place of the propagation constant and impedance specified in the equation.

A dispersion relation such as given by equation (2) can be shown to support a series of pass bands and stop bands. Some of these pass bands support a backward traveling wave (i.e. one in which the imaginary portion of the complex propagation constant is negative.) Under the right choices of values, d, L, and C it is possible to achieve this anomalous behavior in the high frequency band.

Figure 3:
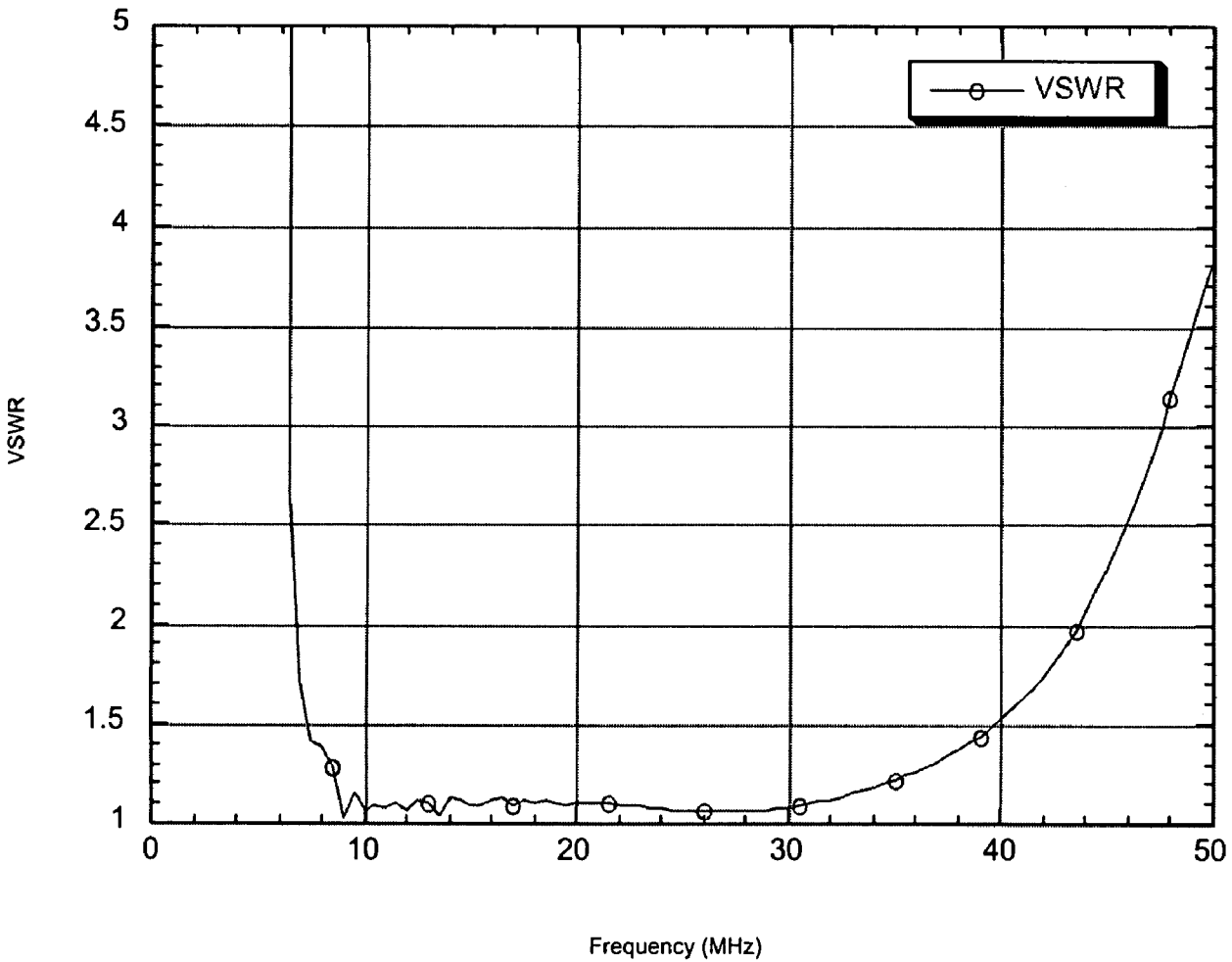
FIG. 3 illustrates a graph of the Voltage Standing Wave Ratio (VSWR) performance of an embodiment of the antenna of the present invention.

In operation, an embodiment of the present invention includes an antenna in which the center conducting wire is a number fourteen American Wire Gauge (AWG) solid copper conductor and the insulation consists of two layer—a low dielectric constant foam with a diameter of 0.500" and an outer Chlorinated Poly Vinyl Chloride (CPVC) jacket with an outer diameter of 0.625" and a wall thickness of 0.0625" whose dielectric constant is 3.7. For such an antenna, immersed in seawater, it can be shown that a pass band starts at approximately 9 MHz when C is chosen to be 200 pF and L=800 nH and d=3.0 inches. FIG. 3 illustrates a graph of the Voltage Standing Wave Ratio (VSWR) performance of this antenna. Based on the plot in FIG. 3 and for a VSWR<2:1 being considered "acceptable" performance, the antenna is seen to have a bandwidth of approximately 5:1 that even extends beyond the end of the high frequency band at 30 MHz, although antenna performance at low frequencies is sacrificed.

The advantages of the present invention are that this antenna design provides a substantially improved impedance bandwidth over prior art antennas at high frequency. It does so without increasing the physical profile of prior art antennas and without the use of active circuit elements.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singly or in combination with other embodiment(s). Therefore, it will be understood that the appended claims are intended to cover all such modifications and embodiments, which would come within the spirit and scope of the present invention.

What is claimed is:

1. A buoyant cable antenna for use with an underwater vehicle comprising:

a plurality of N segments of straight wire of uniform diameter, each segment being of equal length d/2, wherein the number of segments, N, is dictated by the frequency band of operation of said buoyant cable antenna;

a plurality of capacitors coupled in series between every other segment of the plurality of N segments of straight wire such that each of said plurality of capacitors is separated by a distance d;

a plurality of shunt inductors coupled to the adjoining segments of the plurality of N segments of straight wire that are not separated by a capacitor such that the each of said plurality of shunt inductors is separated by a distance d;

a cylindrical layer of buoyant dielectric material surrounding said plurality of N segments of straight wire, capacitors and shunt inductors wherein said cylindrical sheath of dielectric material serves to insulate said N segments of straight wire;

a cylindrical jacket of a non-conducting water proof material disposed over said cylindrical layer of buoyant dielectric material that serves to shield the N segments of straight wire from water;

a coaxial feed line having a first end and a second end, said first end being joined to said underwater vehicle and said second end joined to a first end of one of said plurality of N segments of straight insulated wire, wherein said coaxial feed line serves as a transmission line; and a terminating cap joined to a second end of said straight insulated wire.

2. The buoyant cable antenna of claim 1 wherein said terminating cap is a shorting cap joined to the second end of said antenna element, wherein said shorting cap is a solid metallic structure that connects electrically to the center conductor of the antenna and conforms to the overall diameter of the antenna.

3. The buoyant cable antenna of claim 1 wherein said terminating cap is an insulating cap joined to the second end of said antenna element, wherein said insulating cap is a solid metallic structure that connects electrically to the center conductor of the antenna and conforms to the overall diameter of the antenna.

4. The buoyant cable antenna of claim 1 wherein said buoyant cable antenna behaves like a transmission line whose complex propagation constant and complex characteristic impedance satisfy $$\cosh\bar{\gamma}d = -\frac{Z_0 + (Z_0 - 4\omega^2 LCZ_0)\cosh\gamma d + j2\omega(L + CZ_0^2)\sinh\gamma d}{4\omega^2 LCZ_0}$$

and $$\overline{Z_0^2} = \frac{(2\omega CZ_0\tanh(\gamma d/2) - j)[(4\omega^2 LC - 1)Z_0\cosh(\gamma d/2) - j2\omega(L + CZ_0^2)\sinh(\gamma d/2)]}{4\omega^2 C^2[2\omega L\sinh(\gamma d/2) - jZ_0\cosh(\gamma d/2)]}.$$

* * * * *